US006507970B1

(12) United States Patent
Newlun

(10) Patent No.: US 6,507,970 B1
(45) Date of Patent: Jan. 21, 2003

(54) ELECTRICAL CONNECTION BRUSH AND TESTER ASSEMBLY

(76) Inventor: Brian W. Newlun, 2610 Hupmobile, Cottage Grove, WI (US) 53527

( * ) Notice: Subject to any disclaimer, the term of this patent is extended or adjusted under 35 U.S.C. 154(b) by 434 days.

(21) Appl. No.: 09/609,435

(22) Filed: Jun. 30, 2000

(51) Int. Cl.[7] ..... A46B 15/00

(52) U.S. Cl. ..... 15/106; 15/105; 15/160; 7/170; 324/72.5; 324/133

(58) Field of Search ..... 15/105, 106, 160; 7/107, 164, 170; 324/72.5, 133

(56) References Cited

U.S. PATENT DOCUMENTS

| | | | | | |
|---|---|---|---|---|---|
| 1,986,414 A | * | 1/1935 | Saunders | 324/72.5 X |
| 2,581,116 A | * | 1/1952 | Lewis | 324/72.5 X |
| 2,806,203 A | * | 9/1957 | Church | 324/72.5 X |
| 3,088,150 A | | 5/1963 | Sweeney | 15/106 |
| 4,575,892 A | | 3/1986 | Ross | 15/106 |
| 4,584,526 A | * | 4/1986 | Lobastov | 324/133 |
| 5,115,533 A | | 5/1992 | Hukuba | 15/105 |
| 5,397,996 A | | 3/1995 | Keezer | 324/754 |
| 5,789,911 A | | 8/1998 | Brass | 324/72.5 |
| D408,307 S | | 4/1999 | Blye | D10/78 |

* cited by examiner

*Primary Examiner*—Mark Spisich

(57) ABSTRACT

An electrical connection brush and tester assembly for cleaning electrical contacts to facilitate the flow of electrical current and verify the presence of a voltage at a specified contact. The electrical connection brush and tester assembly includes a handle, a testing rod extending from the handle, a grounding clip, an electrical wire extending between the testing rod and grounding clip, a testing lamp positioned on the handle and illuminated when electric current flows through the testing rod and grounding clip, and a plurality of bristles coupled to the handle.

10 Claims, 2 Drawing Sheets

ELECTRICAL CONNECTION BRUSH AND TESTER ASSEMBLY

BACKGROUND OF THE INVENTION

1. Field of the Invention

The present invention relates to electrical contact cleaning devices and more particularly pertains to a new electrical connection brush and tester assembly for cleaning electrical contacts to facilitate the flow of electrical current and verify the presence of a voltage at a specified contact.

2. Description of the Prior Art

The use of electrical contact cleaning devices is known in the prior art. More specifically, electrical contact cleaning devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,115,533; 3,088,150; 5,397,996; U.S. Pat. No. Des. 408,307; U.S. Patent Nos. 4,575,892; and 5,789,911.

While these devices fulfill their respective, particular objectives and requirements, the aforementioned patents do not disclose a new electrical connection brush and tester assembly. The inventive device includes a handle, a testing rod extending from the handle, a grounding clip, an electrical wire extending between the testing rod and grounding clip, a testing lamp positioned on the handle and illuminated when electric current flows through the testing rod and grounding clip, and a plurality of bristles coupled to the handle.

In these respects, the electrical connection brush and tester assembly according to the present invention substantially departs from the conventional concepts and designs of the prior art, and in so doing provides an apparatus primarily developed for the purpose of cleaning electrical contacts to facilitate the flow of electrical current and verify the presence of a voltage at a specified contact.

SUMMARY OF THE INVENTION

In view of the foregoing disadvantages inherent in the known types of electrical contact cleaning devices now present in the prior art, the present invention provides a new electrical connection brush and tester assembly construction wherein the same can be utilized for cleaning electrical contacts to facilitate the flow of electrical current and verify the presence of a voltage at a specified contact.

The general purpose of the present invention, which will be described subsequently in greater detail, is to provide a new electrical connection brush and tester assembly apparatus and method which has many of the advantages of the electrical contact cleaning devices mentioned heretofore and many novel features that result in a new electrical connection brush and tester assembly which is not anticipated, rendered obvious, suggested, or even implied by any of the prior art electrical contact cleaning devices, either alone or in any combination thereof.

To attain this, the present invention generally comprises a handle, a testing rod extending from the handle, a grounding clip, an electrical wire extending between the testing rod and grounding clip, a testing lamp positioned on the handle and illuminated when electric current flows through the testing rod and grounding clip, and a plurality of bristles coupled to the handle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new electrical connection brush and tester assembly apparatus and method which has many of the advantages of the electrical contact cleaning devices mentioned heretofore and many novel features that result in a new electrical connection brush and tester assembly which is not anticipated, rendered obvious, suggested, or even implied by any of the prior art electrical contact cleaning devices, either alone or in any combination thereof.

It is another object of the present invention to provide a new electrical connection brush and tester assembly which may be easily and efficiently manufactured and marketed.

It is a further object of the present invention to provide a new electrical connection brush and tester assembly which is of a durable and reliable construction.

An even further object of the present invention is to provide a new electrical connection brush and tester assembly which is susceptible of a low cost of manufacture with regard to both materials and labor, and which accordingly is then susceptible of low prices of sale to the consuming public, thereby making such electrical connection brush and tester assembly economically available to the buying public.

Still yet another object of the present invention is to provide a new electrical connection brush and tester assembly which provides in the apparatuses and methods of the prior art some of the advantages thereof, while simultaneously overcoming some of the disadvantages normally associated therewith.

Still another object of the present invention is to provide a new electrical connection brush and tester assembly for cleaning electrical contacts to facilitate the flow of electrical current and verify the presence of a voltage at a specified contact.

Yet another object of the present invention is to provide a new electrical connection brush and tester assembly which includes a handle, a testing rod extending from the handle, a grounding clip, an electrical wire extending between the testing rod and grounding clip, a testing lamp positioned on the handle and illuminated when electric current flows through the testing rod and grounding clip, and a plurality of bristles coupled to the handle.

Still yet another object of the present invention is to provide a new electrical connection brush and tester assembly that has a storage area for the electrical wire leading to the grounding clip.

Even still another object of the present invention is to provide a new electrical connection brush and tester assembly that is designed to clean both male and female contacts for many common connector sets such as those used on trailers, boats, and other electrical connectors exposed to the environment.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
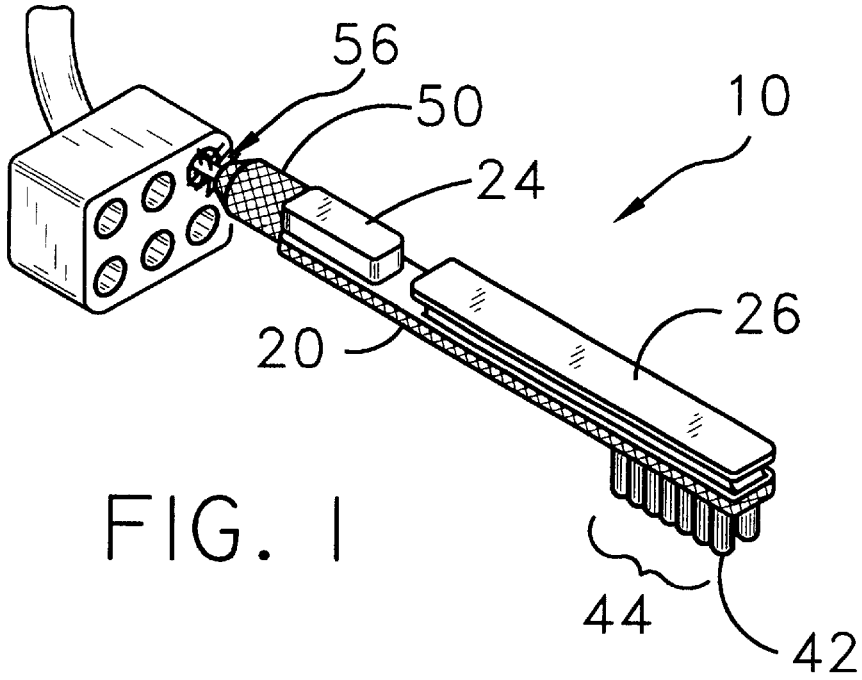
FIG. 1 is a schematic perspective view of a new electrical connection brush and tester assembly according to the present invention.
Figure 2:
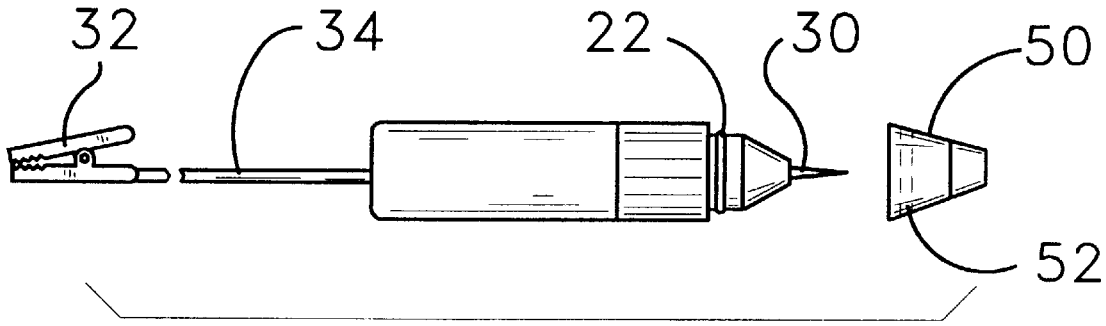
FIG. 2 is a schematic side view of the present invention.
Figure 3:
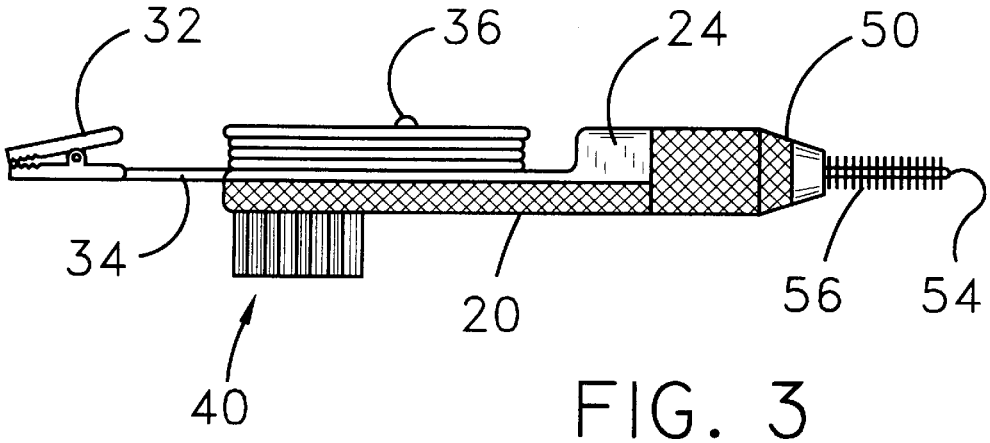
FIG. 3 is a schematic side view of the present invention.
Figure 4:
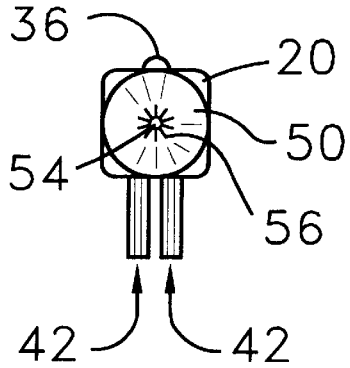
FIG. 4 is a schematic end view of the present invention.
Figure 5:
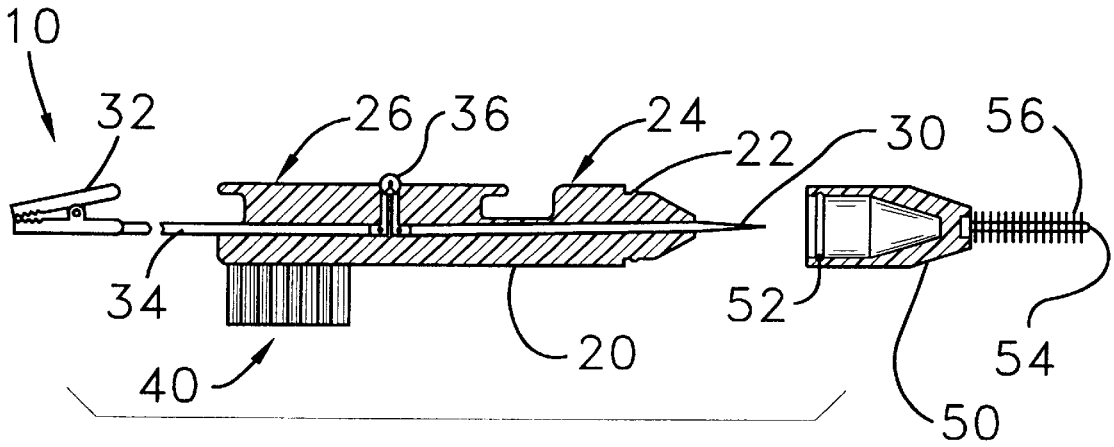
FIG. 5 is a schematic cross-sectional view of the present invention.

With reference now to the drawings, and in particular to FIGS. 1 through 5 thereof, a new electrical connection brush and tester assembly embodying the principles and concepts of the present invention and generally designated by the reference numeral 10 will be described.

As best illustrated in FIGS. 1 through 5, the electrical connection brush and tester assembly 10 generally comprises a handle 20, a testing rod 30, a grounding clip 32, electrical wire 34, a testing light 36, and a plurality of bristles 40.

The testing rod 30 extends outwardly from the handle 20. The electrical wire 34 extends between the testing rod 30 and the grounding clip 32. A portion of the electrical wire 34 extends through the handle 20. Thus the grounding clip 32 is coupled to the handle 20.

The testing light 36 is coupled to an exterior of the handle 20. The testing light 36 is electrically coupled to the electrical wire 34 between the testing rod 30 and the grounding clip 32. Thus the testing light 36 will illuminate upon an electrical current passing through the electrical wire 34.

The plurality of bristles 40 is coupled to the handle 20 and arranged into bristle groups 42. The bristle groups 42 are arranged into a plurality of bristle group rows 44 such that the handle 20 is designed for brushing an electrical connection member for cleaning contact points of the electrical connection member.

A cap member 50 is couplable to an end portion of the handle 20 for covering the testing rod 30. The end portion of the handle 20 includes a circumferential lip 22. The cap member 50 includes a circumferential recess 52 for receiving the circumferential lip 22 when the cap member 50 is engaged to the end portion of the handle 20.

A brush rod 54 extends from the cap member 50. The brush rod 54 is substantially aligned with a longitudinal axis of the handle 20.

A plurality of cap bristles 56 is coupled to the brush rod 54 such that the cap bristles 56 extend radially outward from the brush rod 54. Thus the cap bristles 56 are designed for inserting into a female electrical connection member for cleaning contact points in the female electrical connection member.

The handle 20 includes medial recess for dividing an upper section of the handle 20 into a head portion 24 and a wire storage portion 26. The wire storage portion 26 includes a circumferential groove in an outer perimeter wall of the wire storage portion 26. The circumferential groove is for facilitating wrapping of an exterior portion of the electrical wire 34 around the wire storage portion 26 such that the exterior portion of the electrical wire 34 is selectively engageable to the handle 20.

In use, the male contact of a connector pair is cleaned by abrasion using the bristles coupled to the handle. The female contact is cleaned by abrasion using the cap bristles coupled to the brush rod. The cap member is disengaged from the handle exposing the testing rod. The electrical wire is uncoiled from around the wire storage portion of the handle. The grounding clip is connected to a voltage ground. An illustrative example of a voltage ground would be a chassis. The testing rod is placed in communication with the contact sourcing the electrical current. The light is then checked for illumination, thus verifying the connection.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An electrical connection brush and tester assembly comprising:

a handle;

a testing rod extending outwardly from said handle;

a grounding clip;

an electrical wire extending between said testing rod and said grounding clip, a portion of said electrical wire extending through said handle whereby said grounding clip is coupled to said handle;

a testing light being coupled to an exterior of said handle, said testing light being electrically coupled to said electrical wire between said testing rod and said grounding clip whereby said testing light will illuminate upon an electrical current passing through said electrical wire;

a plurality of bristles coupled to said handle such that said handle is adapted for brushing an electrical connection member for cleaning contact points of the electrical connection member.

2. The electrical connection brush and tester assembly of claim 1, further comprising:

a cap member couplable to an end portion of said handle for covering said testing rod.

3. The electrical connection brush and tester assembly of claim 2, further comprising:

a brush rod extending from said cap member; and a plurality of cap bristles coupled to said brush rod such that said cap, bristles are adapted for inserting into an electrical connection member for cleaning contact points in said electrical connection member.

4. The electrical connection brush and tester assembly of claim 3, further comprising:

said brush rod being substantially aligned with a longitudinal axis of said handle.

5. The electrical connection brush and tester assembly of claim 3, further comprising:

said cap bristles extending radially from said rod whereby said cap bristles are adapted for inserting into a female electrical connection member for cleaning contact points in said female electrical connection member.

6. The electrical connection brush and tester assembly of claim 2, further comprising:

said end portion of said handle having a circumferential lip; and said cap member having a circumferential recess for receiving said circumferential lip when said cap member is engaged to said end portion of said handle.

7. The electrical connection brush and tester assembly of claim 1, further comprising:

said plurality of bristles arranged into bristle groups, said bristle groups being arranged into a plurality of bristle group rows.

8. The electrical connection brush and tester assembly of claim 1, further comprising:

said handle having a medial recess for dividing an upper section of said handle into a head portion and a wire storage portion.

9. The electrical connection brush and tester assembly of claim 8, further comprising:

said wire storage portion having a circumferential groove in an outer perimeter wall of said wire storage portion, said circumferential groove being for facilitating wrapping of an exterior portion of said electrical wire around said wire storage portion such that said exterior portion of said electrical wire is selectively engageable to said handle.

10. An electrical connection brush and tester assembly comprising:

a handle;

a testing rod extending outwardly from said handle;

a grounding clip;

an electrical wire extending between said testing rod and said grounding clip, a portion of said electrical wire extending through said handle whereby said grounding clip is coupled to said handle;

a testing light being coupled to an exterior of said handle, said testing light being electrically coupled to said electrical wire between said testing rod and said grounding clip whereby said testing light will illuminate upon an electrical current passing through said electrical wire;

a plurality of bristles coupled to said handle and arranged into bristle groups, said bristle groups being arranged into a plurality of bristle group rows such that said handle is adapted for brushing an electrical connection member for cleaning contact points of the electrical connection member;

a cap member couplable to an end portion of said handle for covering said testing rod;

said end portion of said handle having a circumferential lip;

said cap member having a circumferential recess for receiving said circumferential lip when said cap member is engaged to said end portion of said handle;

a brush rod extending from said cap member, said brush rod being substantially aligned with a longitudinal axis of said handle;

a plurality of cap bristles coupled to said brush rod such that said cap bristles extend radially outward from said brush rod whereby said cap bristles are adapted for inserting into a female electrical connection member for cleaning contact points in said female electrical connection member;

said handle having a medial recess for dividing an upper section of said handle into a head portion and a wire storage portion, said wire storage portion having a circumferential groove in an outer perimeter wall of said wire storage portion, said circumferential groove being for facilitating wrapping of an exterior portion of said electrical wire around said wire storage portion such that said exterior portion of said electrical wire is selectively engageable to said handle.

* * * * *